US006120332A

United States Patent [19]

Bertens et al.

[11] Patent Number: 6,120,332

[45] Date of Patent: Sep. 19, 2000

[54] APPARATUS FOR CONNECTING AN ELECTRICAL CONNECTOR TO A COMPLEMENTARY CONNECTOR

[75] Inventors: Aloysius Antonius Bertens, Vught; Johannes Marcelus Broeksteeg, Oss; Lambertus Johanna Gerardus Van Brunschot, Oirschot; Johannes Theodorus Maria Roosen, Goirle, all of Netherlands

[73] Assignee: The Whitaker Corporation, Wilmington, Del.

[21] Appl. No.: 09/043,546

[22] PCT Filed: Sep. 17, 1996

[86] PCT No.: PCT/IB96/00954

§ 371 Date: Oct. 26, 1998

§ 102(e) Date: Oct. 26, 1998

[87] PCT Pub. No.: WO97/12425

PCT Pub. Date: Apr. 3, 1997

[30] Foreign Application Priority Data

Sep. 26, 1995 [DE] Germany ..... 195 35 822

[51] Int. Cl.[7] ..... H01R 13/502

[52] U.S. Cl. ..... 439/701; 439/680; 439/362

[58] Field of Search ..... 439/345, 362, 439/660, 677, 680, 681, 717, 701

[56] References Cited

U.S. PATENT DOCUMENTS

| | | | |
|---|---|---|---|
| 3,289,145 | 11/1966 | Ruehlemann et al. . | |
| 3,656,086 | 4/1972 | Debaigt . | |
| 4,484,792 | 11/1984 | Tengler et al. . | |
| 4,611,879 | 9/1986 | Bullard . | |
| 5,387,130 | 2/1995 | Fedder et al. | 439/610 |

FOREIGN PATENT DOCUMENTS

| | | | |
|---|---|---|---|
| 1 169 696 | 5/1959 | France . | |
| 1 526 800 | 5/1968 | France . | |
| 2 120 554 | 8/1972 | France | H01R 23/00 |
| 46/149 | 9/1967 | Germany | H01R 13/645 |
| 71 49 083 | 6/1973 | Germany | H01R 13/64 |
| 80 10 524 | 12/1982 | Germany | H01R 9/16 |
| 85 04 692 | 5/1985 | Germany | H01R 13/64 |
| 36 27 899-C1 | 2/1988 | Germany | H01R 13/514 |
| WO 95/20252 | 7/1995 | WIPO | H01R 43/24 |

*Primary Examiner*—Khiem Nguyen

[57] ABSTRACT

A connection component for an electrical connector that mates with a complementary connector where the electrical connector includes multiple sub-electrical connectors each with an associated housing that has an outer surface with a side with a cut-out therein, the cutout being disposed transversely to the connecting direction of the electrical connector and complementary connector, the sub-electrical connectors are arranged in a stacked manner with the cutouts of the sub-connectors being aligned and connection component is insertable into the aligned cutouts thereby orientating the multiple sub-electrical connectors and where the connection component is configured to cooperate with the complementary connector to assure proper mating

6 Claims, 5 Drawing Sheets

APPARATUS FOR CONNECTING AN ELECTRICAL CONNECTOR TO A COMPLEMENTARY CONNECTOR

BACKGROUND OF THE INVENTION

1. Field of the Invention

The invention relates to an apparatus for connecting at least one electrical connector to at least one complementary connector.

2. Description of the Prior Art

WO 95/20252 A2 discloses an electrical connector, a housing for such a connector and a contact for such a connector. The connectors described in this patent application have a single row of contacts. They are stackable and are fastened to one another by being welded together to form a connector stack. A strain relief element is part of the connector housing. Since these connectors are intended to be mated to a complementary connector, it is desirable to provide a device, which facilitates connection to complementary connectors.

SUMMARY OF THE INVENTION

The object of the invention is to specify an apparatus for connecting an electrical connector stack to a complementary connector where the apparatus can assist such a connection.

If two complementary connectors are to be connected to one another, it is advantageous if the first connector can be fastened to the second connector. The fastening structure serves to fix the two connector halves to one another, but can also serve to assist in joining the two connector halves together.

It is often an additional requirement that a connector can be mated with a complementary connector only in a specific orientation. This is referred to as polarization. For example, the connector is intended to be introduced into the complementary connector only in one orientation and not in an orientation that is rotated with respect thereto. Furthermore, coding of the connector pair may also be required. Such coding satisfies the purpose that only the electrical connector that should be inserted into the complementary connector will be accepted and another electrical connector, bearing a different coding, will not be able to be inserted.

Since the coding with which a connector is supposed to be provided is often not known, nor whether a connector is also supposed to have means for fastening, it would be extremely helpful if it is possible to interchange the fastening or coding apparatus on a connector.

When a connector is constructed modularly and comprises a whole series of individual connectors, a connector stack, then it is expedient that not every one of these individual connectors bears fasteners, or coding structure, rather the entire connector module can be equipped with these features.

An electrical connector having an apparatus for connecting the electrical connector to at least one complementary connector is disclosed which serves both for connecting an individual electrical connector to an individual complementary connector, and for connecting an electrical connector formed as a stacked module of a plurality of electrical connectors, to a complementary connector, possibly also of modular construction.

In the modularly constructed electrical connectors, each of the individual connectors have housings. These housings include a cutout on at least one side and the cutout is of identical configuration in the individual housings and the cutouts are aligned. A connection component is configured to be pushed into the aligned cutouts perpendicularly to the mating direction of the connector and parallel to that side of the connector in which the cutout is situated. The connection component can also be removed from the cutout in this direction. If a plurality of connectors are combined in a module, then it is expedient to provide only one connection component for a series of cutouts lying adjacent one another. The height of this connection component then corresponds to the height of the entire module.

Either a fastening member or a coding member or both can be provided on the exchangeable connection component. For example, a latching arm having a latching hook, or a latching lug may be used as the fastening member, if corresponding, complementary structure is provided on the complementary connector or housing, wall or printed circuit board containing the complementary connection. A lifting screw may also be used as the fastening member.

The coding member may, for example, include colour codings or lugs which engage in corresponding cutouts in the complementary connector or housing wall or printed circuit board containing the complementary connection.

A particularly advantageous and reliable configuration of cutout and connection component is achieved if the cutout is configured in the form of a dovetail mortise and the connection part has a dovetail tenon.

The housing of the electrical connector can have cutouts not only on one side but on a number of sides. It is particularly advantageous to provide such cutouts on two opposite sides of the housing. If it is intended to use the connection component for fixing the connector. It is expedient for a connection part to be introduced into both opposite cutouts. However, if the connection part serves only for coding, then it is sufficient if it is provided on only one of the sides.

If a module of a plurality of connectors is used, then these connectors are welded together. Prior to welding, however, it is necessary for the connectors to be adjusted with respect to one another. If a cutout is provided on the connector housings in the manner described above, then it is possible to introduce the corresponding connection component into this cutout. The individual connectors are thereby aligned with one another. Once aligned, the individual connectors can then be welded. The connection part can thus be used not only for fixing and coding but also for alignment.

DETAILED DESCRIPTION OF THE PREFERRED EMBODIMENT

Figure 1:
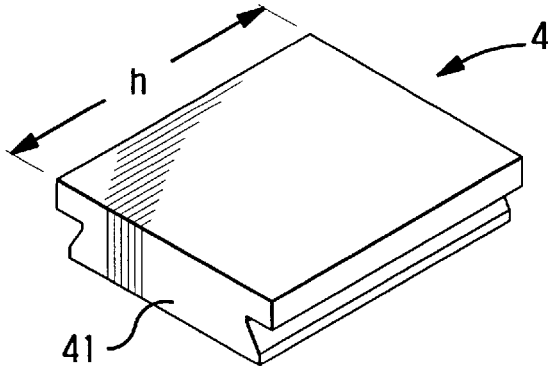
FIG. 1 shows perspective view of a connection component according to the present invention.

FIG. 1 shows a connection component 4 according to the present invention, which may be made from metal or plastic. The connection component 4 has a dovetail tenon 41. The tenon 41 extends over the entire height h of the connection component 4. The connection component 4 configured as in FIG. 1 can be used for example for the alignment and attachment of a plurality of connectors which are to be joined together to form a modularly constructed connector, as described below.

Figure 2:
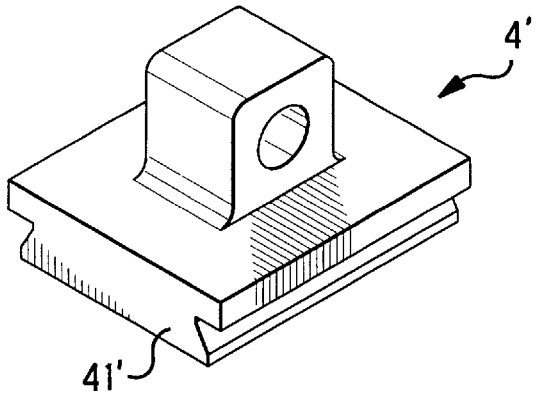
FIG. 2 shows a perspective view of an alternative embodiment of a connection component according to the present invention.

FIG. 2 shows another connection component 4' with a dovetail tenon 41'. In addition, the connection component 4' has a part which is integrally formed therewith and has a hole extending therethrough. This hole serves to receive a lifting screw 5 (see FIG. 5). The hole is oriented perpendicularly to the dovetail tenon 41'.

Figure 3:
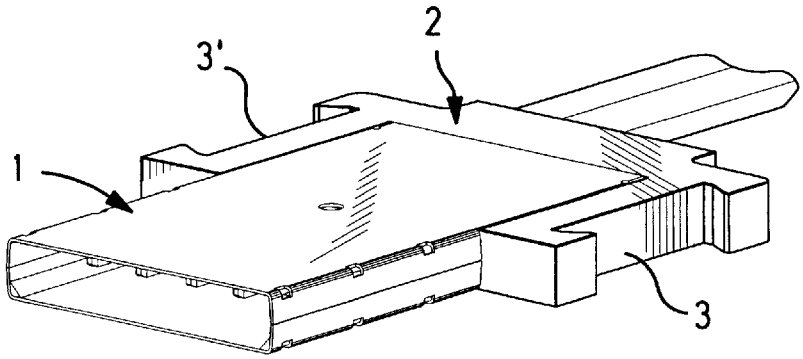
FIG. 3 shows a perspective view of an individual connector usable with the connection components of FIGS. 1 or 2.

FIG. 3 illustrates a connector 1 with a housing 2. The housing 2 has cutouts 3, 3' on two opposite sides that are constructed to receive one of the connection components 4, 4'. The cutouts 2 are therefore formed as dovetail mortises and can receive the dovetail tenon 41, 41' of the connection component 4, 4'. The dovetail tenon 41, 41' is inserted in a direction perpendicular to the mating or insertion direction of the mating pair of connectors and parallel to the side of the housing 2 on which the given cutouts 3, 3' is provided. The connection component 4, 4' can also be removed from the cutout 3, 3' in this direction.

Figure 4:
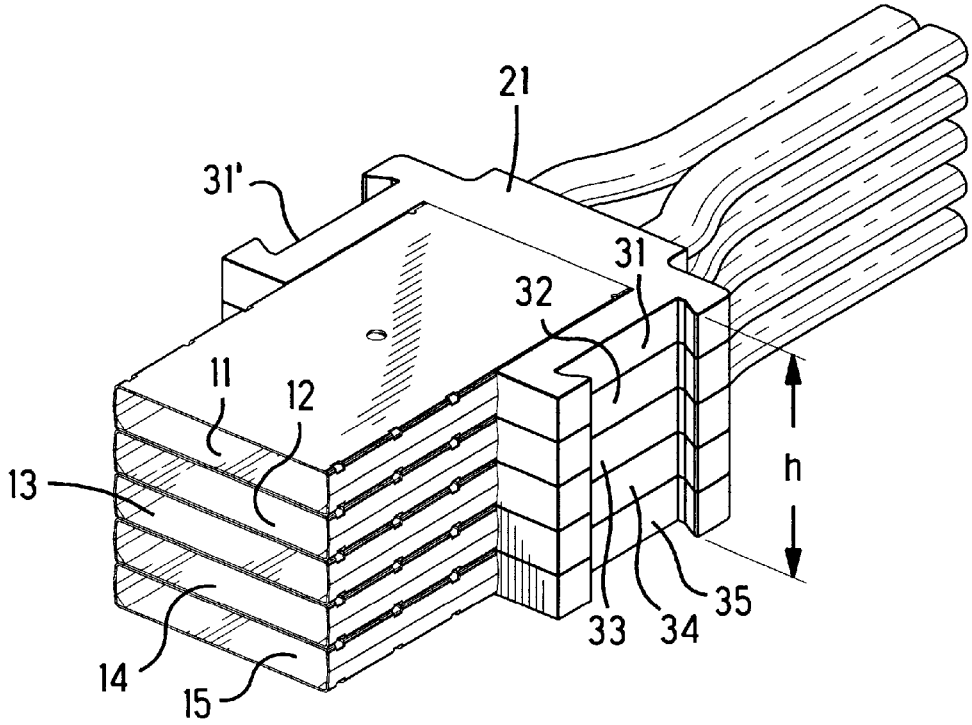
FIG. 4 shows a perspective view of a module or connector stack comprising five connectors of the type shown in FIG. 3.

FIG. 4 shows a modularly constructed connector which is composed of a plurality of individual connectors 11–15 which are fitted one on adjacent the other. Each of the connectors 11–15 has a housing 21, which has cutouts 31–35; 31' on opposite sides. One of the connection components 4, 4' can be inserted into respective aligned cutouts 31–35. The height h of the dovetail tenon of the connection component 4 corresponds to the height h of the entire connector stack. A connection component 4,4' of the kind illustrated in FIG. 1 can be used to align the various connectors 11–15 with one another before they are welded together. For this purpose, the connection component 4, 4' is inserted into the cutouts 31–35 thereby aligning the connectors 11–15 with respect to one another.

Figure 5:
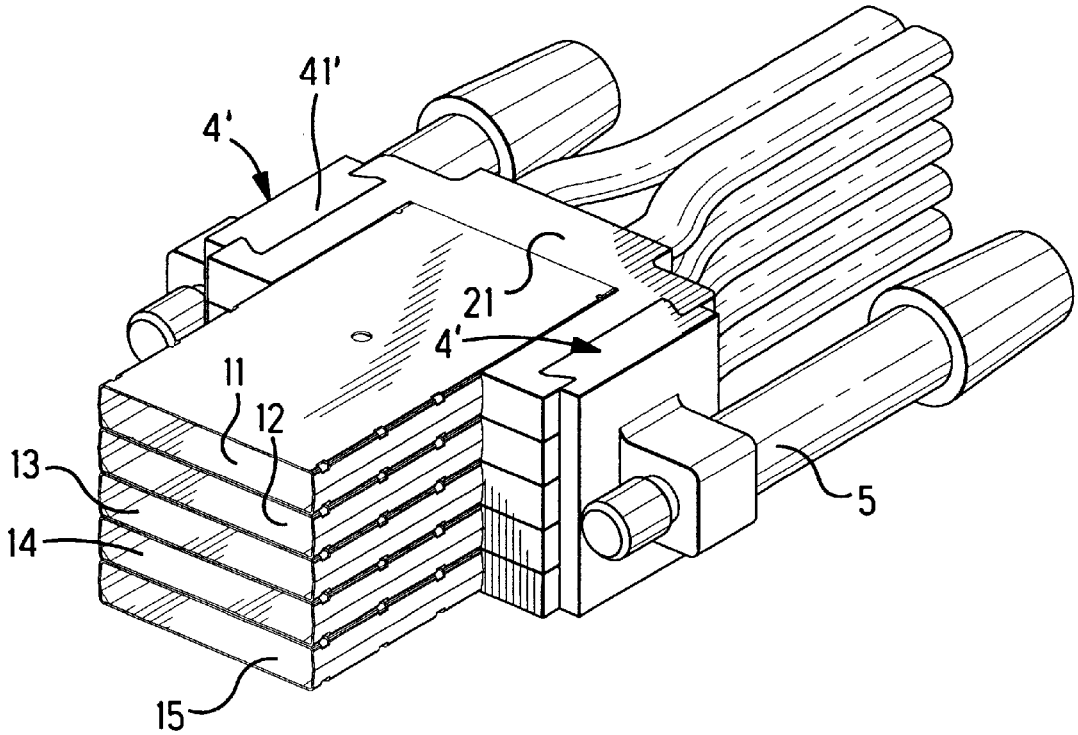
FIG. 5 shows a perspective view of the module of FIG. 4 having the connection component of FIG. 2 with a lifting screw therein.

FIG. 5 illustrates the modular connection arrangement, illustrated in FIG. 4, with the connection components 4' received in the cutouts 31–35. The connection component 4' corresponds to the connection component 4 illustrated in FIG. 2. Each connection component 4' is provided with a lifting screw 5, which serves to fix the modularly constructed connector to a complementary connector or in a housing wall which carries the connector.

Figure 6:
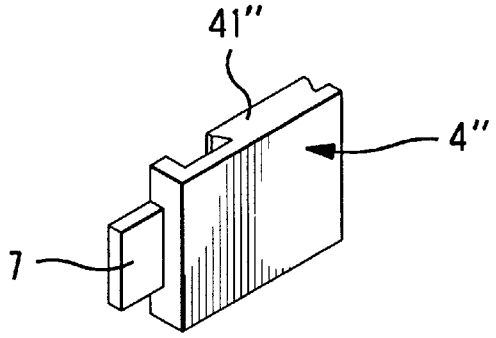
FIG. 6 shows a perspective view of yet another embodiment of FIG. 2 having a connection component according to the present invention.

FIG. 6 illustrates another possible configuration of a connection component shown at 4". The connection component 4" likewise has a dovetail tenon 41" and, in addition, a coding member 7. The coding member 7 is designed in the form of a peg which extends in the direction towards the complementary connector.

Figure 7:
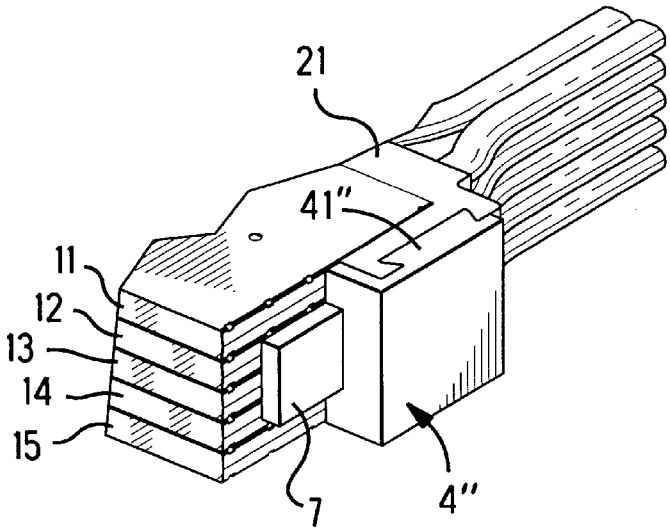
FIG. 7 shows a partial perspective view of the module of FIG. 4 with the connection component of FIG. 6.
Figure 8:
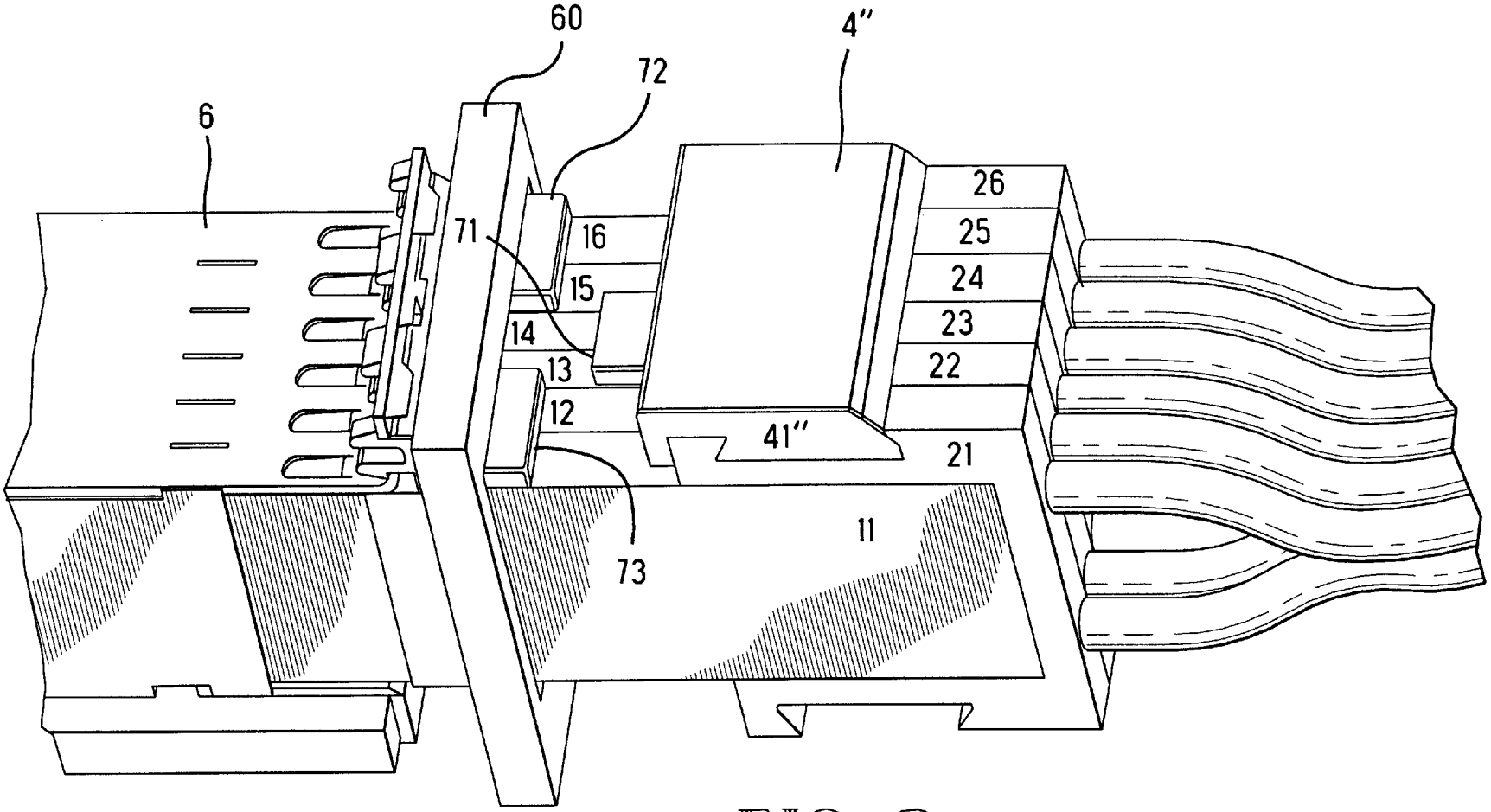
FIG. 8 shows a perspective view of the module of FIG. 7 and a complementary connector in a front covering plate.
Figure 9:
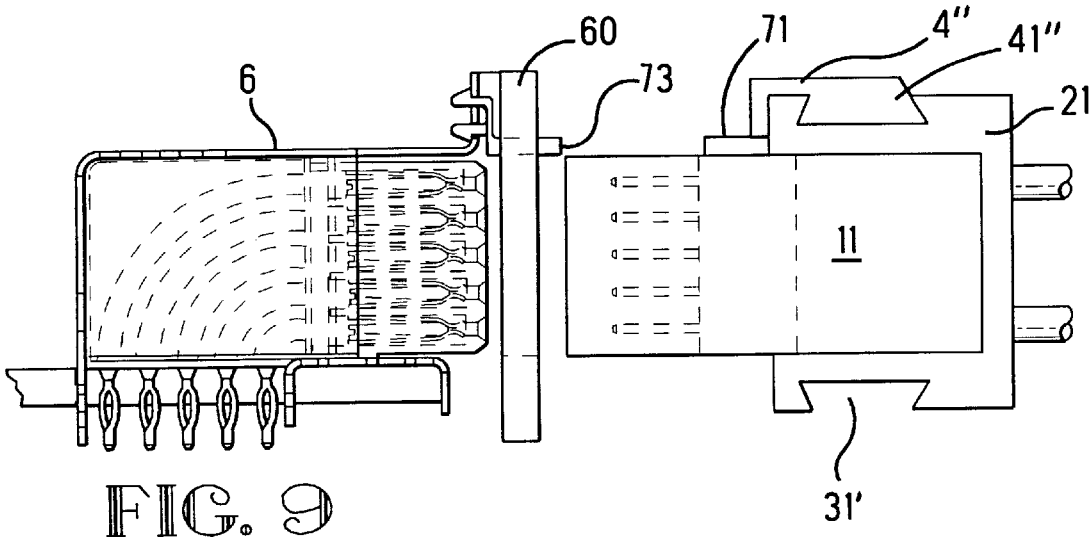
FIG. 9 shows a side representation of the connectors of FIG. 8 aligned for mating the procedure for connecting the arrangement illustrated in FIG. 8.
Figure 10:
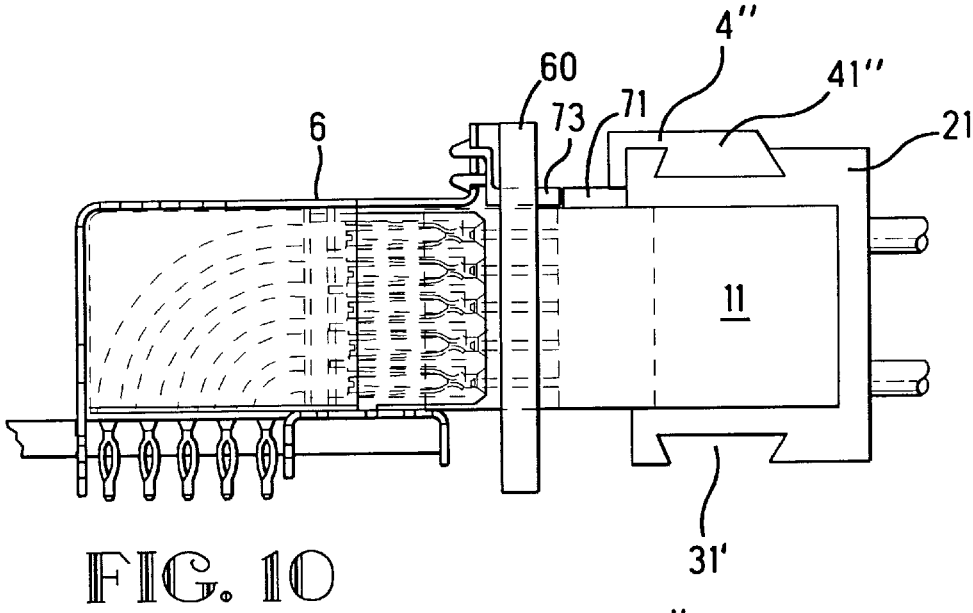
FIG. 10 shows a side representation according to FIG. 9 in an initially mated state.
Figure 11:
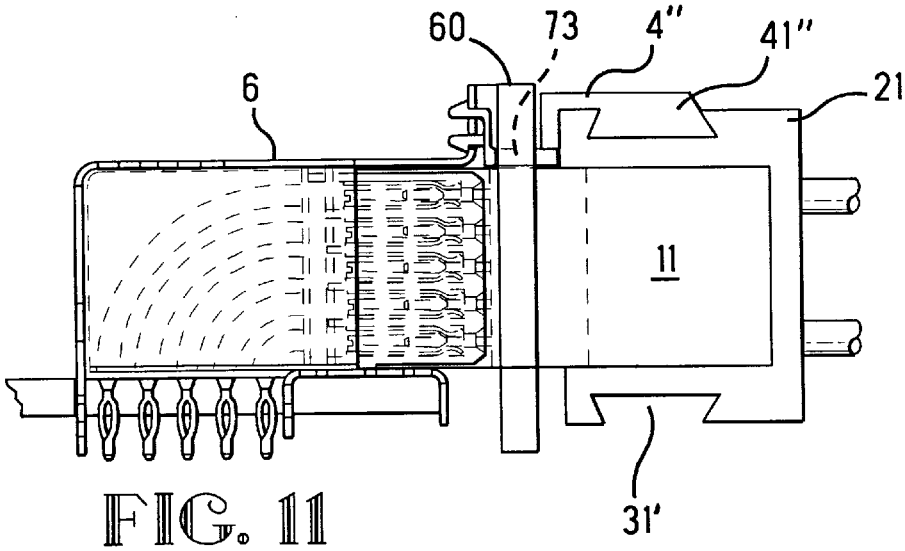
FIG. 11 shows a side representation according to FIG. 9 in a fully mated state.

FIGS. 8 to 11 illustrate how a connector according to FIG. 7 interacts with a complementary connector. In FIG. 8, it is possible to discern the modularly constructed connector with the connectors 11–16 and the associated housings 21–26, as well as the connection component 4" with a dovetail tenon 4" and coding member 7. In addition, a complementary connector 6 which is fixed in a front covering plate 60 can be discerned. The complementary connector 6 likewise has two coding lugs 72 to 73, which extend towards the first connector. When the connectors are joined in the manner illustrated in FIGS. 9 to 11, the coding member 7 then engages between the two coding lugs 72 and 73. Rotation of the connector through 180° is not possible, since the lug 71 will then bump against the front covering plate 60 so that mating cannot take place. It is also not possible for connectors having a different coding, in which the lug 71 is provided at a different location, for example, to be inserted into the complementary connector.

Figure 12:
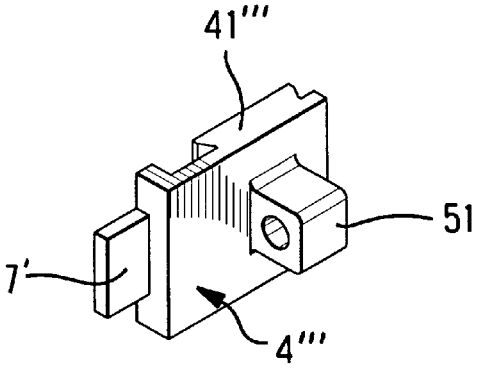
FIG. 12 shows a perspective view of yet another alternative embodiment of a connection component according to the present invention.
Figure 13:
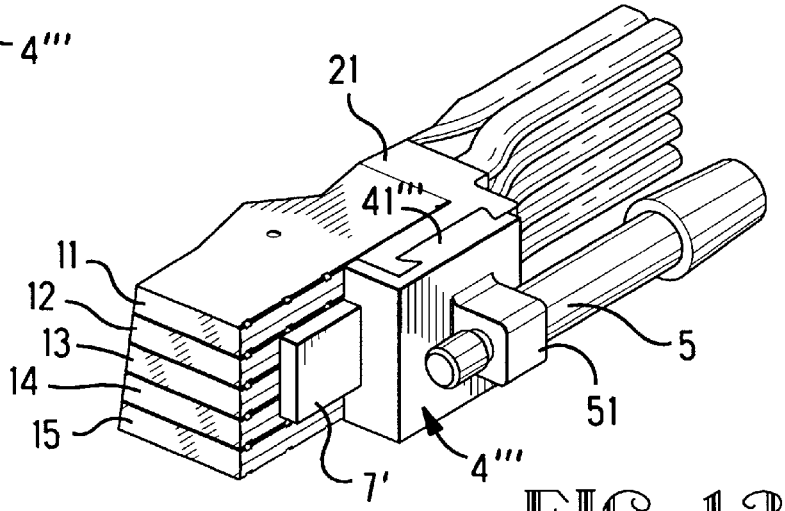
FIG. 13 shows a partial perspective view of the module of FIG. 4 with the connection component of FIG. 12.

FIGS. 12 and 13 then illustrate a connection part 4'" which bears both a fixing member 5, 51 and coding member. The lifting screw 5 is fixed in a hole of a moulding 51 on the connection component 4'". In addition, the connection component 4'" has a coding lug 7 as already described above.

What is claimed is:

1. An electrical connector for connecting to a complementary connector comprising:

a plurality of sub-electrical connectors;

a housing associated with each of the sub-electrical connectors, each housing having an outer surface with a side with a cut-out therein, the cutout being disposed transversely to the connecting direction of the electrical connector and complementary connector, where the plurality of sub-electrical connectors are arranged in a stacked manner with the cutouts of the sub-connectors being aligned; and a connection component insertable into the aligned cutouts where the connection component is configured to cooperate with the complementary connector to assure proper mating.

2. The electrical connector of claim 1, wherein the cutouts have a dovetail form and the connection component has a complementary tenon.

3. The electrical connector of claim 2, wherein the connection component includes a part thereof with a lifting screw for maintaining the connector and complementary connector joining the connector in a mated arrangement.

4. The electrical connector of claim 2, wherein the connection component includes a lug extending therefrom, whereby the lug cooperates with the mating connector to assure desired mating occur.

5. The electrical connector of claim 3, wherein the connection component includes a lug extending therefrom, whereby the lug cooperates with the mating connector to assure desired mating occur.

6. The electrical connector of claim 1, wherein the housing has a pair of cutouts with corresponding connection components disposed in each cutout.

* * * * *